US006129650A

United States Patent [19]

Wedge, Jr.

[11] Patent Number: 6,129,650

[45] Date of Patent: Oct. 10, 2000

[54] EXERCISE BAR

[76] Inventor: Roy D. Wedge, Jr., 4408 Cruz Dr., Midland, Mich. 48642

[21] Appl. No.: 09/193,912

[22] Filed: Nov. 17, 1998

Related U.S. Application Data

[60] Provisional application No. 60/066,762, Nov. 19, 1997.

[51] Int. Cl.[7] ..... A63B 21/00

[52] U.S. Cl. ..... 482/139; 482/38; 482/44; 482/91; 482/907

[58] Field of Search ..... 482/44–46, 91, 482/92, 95, 106, 109, 131, 139, 148, 907, 38; 601/33; 135/65, 75; 463/47.6

[56] References Cited

U.S. PATENT DOCUMENTS

| | | | |
|---|---|---|---|
| D. 267,420 | 12/1982 | Malachowsky . | |
| D. 320,636 | 10/1991 | Eckler . | |
| D. 351,878 | 10/1994 | Globus . | |
| 1,552,073 | 9/1925 | Mansfeldt . | |
| 2,408,604 | 10/1946 | Brickson | 135/75 |
| 3,117,781 | 1/1964 | Vargo . | |
| 3,820,781 | 6/1974 | Kane . | |
| 4,257,591 | 3/1981 | Evans, Sr. . | |
| 4,513,963 | 4/1985 | Nelson et al. . | |
| 4,563,004 | 1/1986 | Mattox . | |
| 4,623,146 | 11/1986 | Jackson . | |
| 4,664,370 | 5/1987 | Finch . | |
| 4,718,666 | 1/1988 | O'Donnell et al. . | |
| 4,770,414 | 9/1988 | Fredrickson et al. . | |
| 4,822,035 | 4/1989 | Jennings et al. . | |
| 4,858,917 | 8/1989 | Montgomery . | |
| 4,863,158 | 9/1989 | Tassone . | |
| 4,869,491 | 9/1989 | Nolan . | |
| 5,029,847 | 7/1991 | Ross . | |
| 5,062,633 | 11/1991 | Engel et al. | 482/139 |
| 5,080,349 | 1/1992 | Vittone . | |
| 5,167,596 | 12/1992 | Ferber . | |
| 5,190,512 | 3/1993 | Curran . | |
| 5,269,737 | 12/1993 | Sobotka . | |
| 5,352,174 | 10/1994 | Mason et al. . | |
| 5,358,462 | 10/1994 | Calderone | 482/139 |
| 5,413,548 | 5/1995 | Hoffman | 482/44 |
| 5,536,227 | 7/1996 | Polchek et al. . | |
| 5,556,368 | 9/1996 | Akin . | |
| 5,842,960 | 12/1998 | Yu | 482/131 |

OTHER PUBLICATIONS

Bodybuilder's Discount Outlet, 3–Way Lat Blaster, item No. MB–336, 1995 summer catalog, p. 42.

Anderson, Lori T; Shoulder Pain in Hemiplegia, The American Journal of Occupational Therapy; vol. 39, pp. 11–19 (1985).

Schneider, R.C.; Kennedy, J.C.; Plant, M.L.; The Treatment of Shoulder and Elbow Trauma in the Athlete; Sports Injuries: Mechanisms, Prevention, and Treatment; Chapter 37; Williams & Wilkins, Baltimore, MD (1985).

*Primary Examiner*—John Mulcahy
*Assistant Examiner*—Victor Hwang
*Attorney, Agent, or Firm*—Miller Johnson Snell & Cummiskey, P.L.C.

[57] ABSTRACT

A shoulder exercise bar intended for use with hemiplegic patients is provided which maintains a patient's hands in proper position during shoulder exercises and may also be used for elbow and wrist exercises. The shoulder exercise bar includes a crossbar which is adjustable in length to fit a particular patient. A plurality of handles are provided at each end of the crossbar to be grasped by the patient demonstrating weakness. One of the handles is angularly offset at each end with respect to a longitudinal axis defined by the crossbar and provides for versatile strengthening and stretching exercises for the patient. The orientation of the handles also encourages self resisted or isotonic strengthening exercises.

14 Claims, 2 Drawing Sheets

EXERCISE BAR

CROSS REFERENCE TO RELATED APPLICATIONS

This application claims priority to prior provisional application Ser. No. 60/066,762—filed Nov. 19, 1997.

BACKGROUND OF THE INVENTION

1. Field of the Invention

This invention relates to exercise equipment used to rehabilitate and strengthen a patient's upper extremity, and particularly to a form of exercise equipment for use by stroke or hemiplegic patients to reduce muscle tension and spasms in the shoulder, elbow and wrist muscle groups.

2. Discussion of the Related Art

One of the more common problems of a stroke is the decreased function of the upper extremity. A severe stroke will usually make one of the victim's arms nonfunctional. The arm moves through stages of recovery that range from completely flaccid, to spastic, to possible return of normal function. A large number of stroke victims have some form of spasticity that affects their ability to use their arm. When muscles become spastic, they are tighter than a normal muscle. Imagine tensing one's bicep to hold a ten pound weight. Such tension exists all the time in a spastic muscle. The involved muscles are receiving messages from the damaged brain that tell them to contract. There are varying levels of spasticity that range from mild to severe.

Spastic muscles are shortened muscles and need to be forcefully extended frequently to prevent permanent deformity. One of the most common postures created by spastic muscles of a stroke victim is a flexor synergy. In the upper extremity, this posture can be easily seen as internal rotation of the shoulder, adduction of the arm, flexion of the elbow, pronation of the forearm, flexion of the wrist, ulnar deviation of the wrist, and flexion of the fingers. With severe spasticity this posture will surely become somewhat permanent as shortened muscles lose their ability to stretch and become permanently fixed in the contracted position. The fixed, shortened muscle forms what is commonly called a contracture. A contracture can be most easily recognized by the fixed nature of the joints of the involved extremity. The only way to prevent formation of a contracture is through a consistent stretching program and aggressive positioning of the affected arm. When stretching and positioning are ignored, range of motion becomes very limited and cannot be increased effectively once the contracture has formed. With severe spasticity, even a conscientious program of stretching and positioning cannot prevent some level of contracture and deformity of the arm. Fortunately, not all stroke victims have severe spasticity. In fact, many stroke victims move through stages of flaccidity to spasticity to normal function.

Throughout recent history there have been numerous devices for use in exercising and rehabilitation of a stroke patient's shoulder, elbow and wrist muscles. Therapists typically give patients "cane exercises" (FIG. 1), where the patient holds the cane or bar with their hands wrapped around the longitudinal axis of the cane. Placement of the hands in this manner affects the shoulder position by rotating the humerus and greater tuberosity inwardly, increasing the possibility of the greater tuberosity impinging upon the shoulder during the exercise and producing a painful disabling shoulder condition. Placing the hands in a position perpendicular to the longitudinal axis of the cane rotates the humerus and greater tuberosity outwardly as desired for shoulder flexion and shoulder abduction exercises. Schneider, Kennedy, and Plant, in their book entitled, "Sports Injuries: Mechanisms, Prevention, and Treatment" describe impingement injuries to the rotator cuff and emphasize the need for a shoulder strengthening program that focuses on the rotator cuff muscles. These exercises are done with the elbow close to the side, externally rotating and internally rotating the shoulder against resistance. Stretching exercises to regain full range of motion are also very necessary. There is a need for a shoulder exercise device that maintains proper shoulder position, has multiple handles for varied arm spread, is light and relatively compact, and is affordable for clinic and home use.

U.S. Pat. No. 4,664,370 describes the use of a flat metal bar with a complicated handle mechanism for use in exercising a person's wrists, arms and upper body. Changing the working length of the device requires the unfastening of wing nuts and physically repositioning the handles by detaching and reattaching them. The length of the flat longitudinal bar is described as approximately the width of a person's shoulders, but since it is made of a single piece of flat stock, cannot adjust to accommodate patient's of different shoulder widths. In addition, the bar is made from aluminum or steel which presents a serious hazard to patients who sometimes have great difficulty controlling their movements. The hazard is accentuated by the angular nature of the bar's edges, and protruding wing nuts.

U.S. Pat. No. 4,513,963 teaches the use of a similar device that incorporates weights and has a protective covering. The patent does not teach, however, the use of multiple handles to provide flexibility of arm spread and specific hand orientation for the user. Using the weights incorporated in the handles would not be suitable for substantially all of the rehabilitation population targeted by the present invention.

SUMMARY OF THE INVENTION

One form of the rehabilitation exercise bar embodying the invention includes a telescoping tubular crossbar, the length of which is adjustable. The adjustable length encompasses a range which permits use by persons having either narrow or wide shoulders. It also allows the person to adjust the length to wider than shoulder width for some exercises. Dual handles are provided at each end of the crossbar, substantially perpendicular thereto and substantially parallel to each other. The handles are provided with rotatable grips to maintain a relatively neutral position of the user's wrist when using the exercise bar. The base connector piece joins the handles and provides a substantially flat surface to support the user's weak or disabled hand. The connector piece interconnecting the two handles is angled with respect to the longitudinal axis of the bar, preferably at about a 45 degree angle. The handle assembly also provides a wider grasp point of the bar, by using the outer handle, without requiring the crossbar length to be readjusted. In a preferred form of the invention, the exercise bar is made from a polymeric tubing, such as polyvinyl chloride or similar material. It is further contemplated that products may be introduced to the interior of the exercise bar, such as water, sand, or other aggregate or fluid to increase the overall weight of the device.

These and other features, advantages and objects of the present invention will be further understood and appreciated by those skilled in the art by reference to the following specification and appended drawings.

DETAILED DESCRIPTION OF THE VARIOUS EMBODIMENTS

Figure 2:
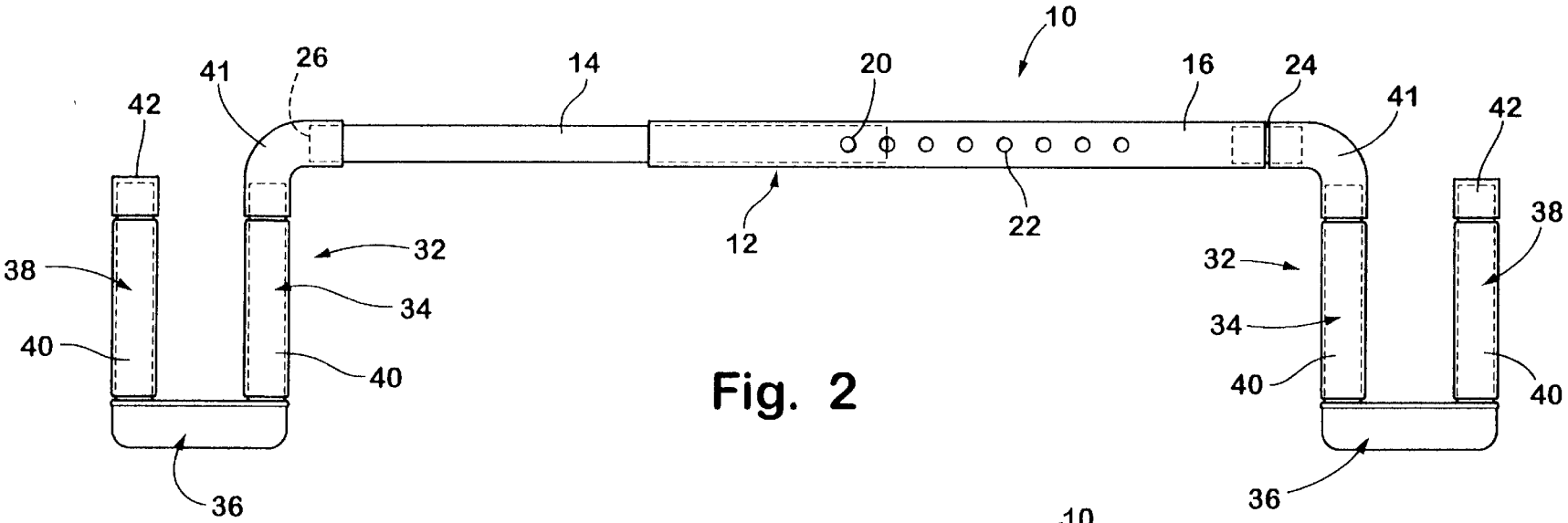
FIG. 2 is a front elevation view of one form of the shoulder exercise bar embodying the present invention.

For purposes of the following description, the terms "upper," "lower," "left," "rear," "front," "vertical," "horizontal" and derivatives of such terms shall relate to the invention as oriented in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Specific dimensions and other physical characteristics relating to the embodiments disclosed herein are not to be considered as limiting, unless the claims expressly state otherwise.

Figure 3:
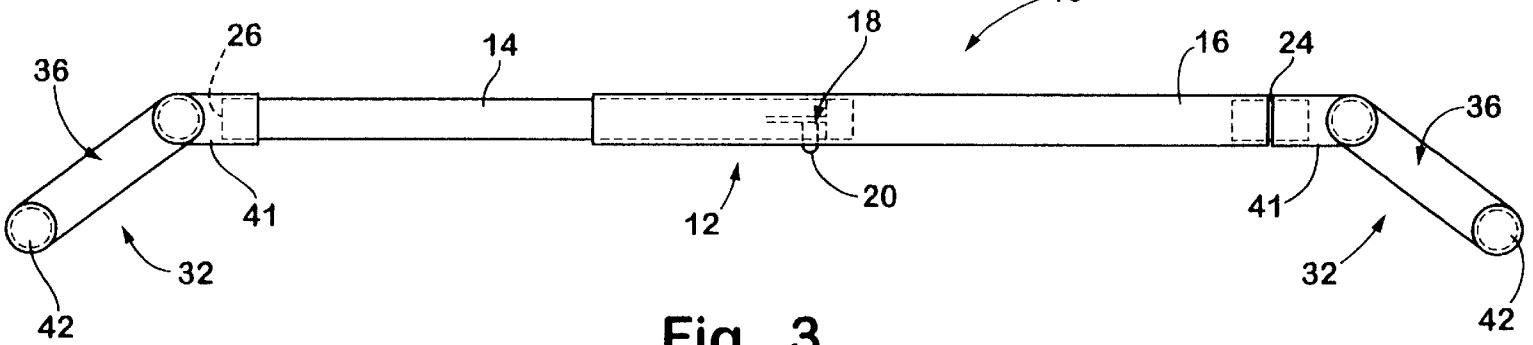
FIG. 3 is a plan view of the invention.

Referring to FIGS. 2 and 3, the exerciser bar 10 embodying the invention includes crossbar assembly 12 preferably formed from two coaxially telescoping tubes 14 and 16 formed from aluminum or PVC pipe. Tube 14 preferably includes a spring clip 18 disposed therein at one end with a tip 20 extending through a hole for reasons which will become apparent below. Outer tube 16 includes a plurality of holes 22 extending therethrough at indexed positions for receiving the tip 20 and fixing the relative telescoping position of the two tubes.

Opposite ends 24, 26 of the crossbar assembly 12 each include a handle assembly 32 (FIGS. 2 and 4) to provide the user at least two different grip positions. Each handle assembly 32 includes a first handle 34 extending substantially perpendicular from each end of the crossbar assembly 12. The opposite end of each handle 34 is connected to one end of a handle extension assembly 36. The opposite end of the handle extension assembly 36 receives a second handle 38 therein extending upright and substantially parallel to the first handle 34. Each handle 34, 38 preferably includes a coaxial grip 40 journaled on each handle 34, 38 to permit rotation for reasons which will be described below. In the case of handle 34, the coaxial grip 40 is retained on the handle by the coupling 41 with the end of the crossbar 12 and the coupling with the handle extension assembly 36. With respect to handle 38, the coaxial grip 40 is retained by a cap 42 received over the free end of the handle. Each coaxial grip 40 preferably includes a cylindrical inner member 43 received and journaled on each handle 34, 38, preferably made from a larger diameter piece of PVC tubing. The inner member 43 is then preferably covered by a polymeric covering or coating 44 to provide a gripping surface and improve tactile sensitivity. More particularly, it is preferred to use a moderate to high density closed cell foam for easy cleaning and durability reasons.

Each handle extension assembly 36 is preferably angled at a fixed position of about forty-five degrees with respect to a vertical plane passing through the longitudinal axis of the crossbar 12, yet is substantially parallel to a horizontal plane passing through the longitudinal axis of the crossbar 12. See FIGS. 2 and 3. The angular orientation of the handle extensions 36 provides vertical stability to the entire assembly 10 when resting on a level surface. Although a forty-five degree angle is preferred, substantially any acute angular orientation may be used wherein handle 38 is still outboard of handle 34 so as not to interfere with either of the user's wrist positions while moving the exercise bar to the fullest lateral extension on either side of the body when the user's body is positioned on the U-shaped side of the exercise bar assembly 10.

Figure 1:
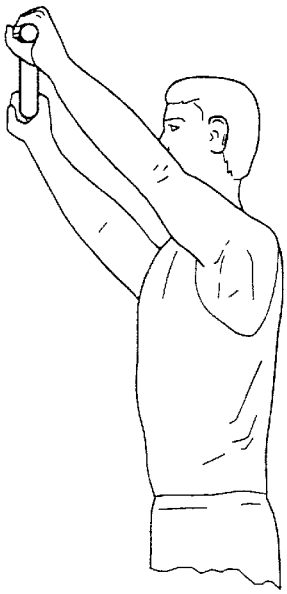
Fig. 1 (PRIOR ART)
FIG. 1 is a view of a user's typical hand placement during cane exercises.
Figure 4:
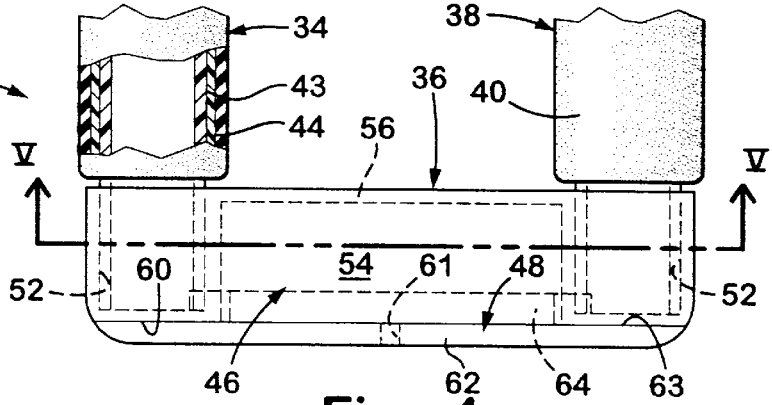
FIG. 4 is a fragmentary elevation section view of the handle assembly of the invention.
Figure 5:
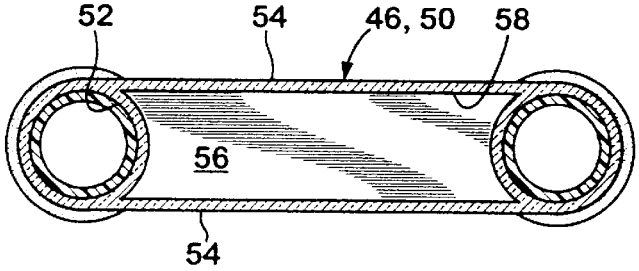
FIG. 5 is a section view of the handle assembly taken along line V—V shown in FIG. 4.
Figure 6:
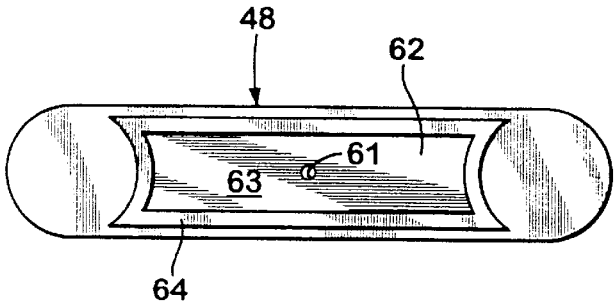
FIG. 6 is a plan view of a cap portion of the handle assembly.

Each handle extension assembly 36 is preferably formed from two components—a cup portion 46 and a cap portion 48 (FIGS. 4, 5, and 6). Cup portion 46 is preferably formed by injection molding and includes a generally oval body 50 having a cylindrical recess 52 defined at opposite ends and configured to receive an end of each handle 34, 38 therein. Each recess 52 is interconnected by a side web 54 and a top web 56, leaving a cavity 58 on a bottom side 60 opposite top web 56. The cap portion 48 includes a generally flat web 62 complimentary to the generally oval shape of the cup portion 46. Extending upwardly from a central portion of one side 63 of the web 62 is a prominently raised ridge 64 having a configuration which closely conforms to the inside perimeter of the cavity 58 defined on the bottom side 60 of the cup portion 46. A suitable adhesive (PVC-type) is preferably applied to ridge 64 and portions of web 62 contacting the bottoms of recesses 52 and applied to the bottom side 60 such that ridge 64 is received in cavity 58. The ridge forces the bottoms of recesses 52 outwardly, and in cooperation with top and side webs 54 and 56, results in a very rigid assembly capable of withstanding substantial bending moments produced by handles 34, 38. Air trapped within cavity 58 is able to escape through a vent hole 61 when the two components are assembled.

In an alternate embodiment of the invention, the crossbar assembly 12 may have a fixed length, and made from a single piece of tubing. In such a configuration, the length of the bar may range from about eighteen inches up to about thirty-six inches to accommodate user's of different size, and to provide a wide range of motion and/or isotonic exercises.

The instant invention was designed to assist with range of motion exercises for the upper extremity. These exercises include stretching, active range of motion, active assisted range of motion, and strengthening with isotonic motions. It was specifically designed to assist with exercise for individuals with decreased function of one or both arms and can be especially helpful with patients experiencing spasticity which requires a stretching program. The angle, and the spacing of the handle assembly combine to position the wrist of the user at neutral when the arm reaches straight out to the front. It should be noted that an individual with spasticity may be able to raise the affected arm into shoulder flexion, but the pattern of movement most often includes internal rotation of the shoulder, flexion of the elbow, and accompanied pronation of the forearm with flexion of the wrist. With the handle positioning of the exercise bar 10, the hand may be assisted into a pattern reducing the pronation and wrist flexion while the elbow is assisted into a pattern of decreased flexion. Stretching of the affected upper extremity can be accomplished with the user in supine, standing, sitting, or even with the affected arm supported on a table top.

In operation, the user either selects the appropriate sized exercise bar assembly, or adjusts the bar assembly to the desired length by way of the spring clip described above. The user orients the exercise bar such that the U-shaped side is facing toward the user. A therapist may assist the user by positioning themselves on the opposite side. By gripping either the inner or outer handles 34, 38, the user's hand is oriented vertically which rotates the user's humerus upward and outwardly so that the acromial process in the scapula is avoided by the greater tubercle (tuberosity) of the humerus when the arms are raised. For stroke patients who have more muscle tone in the arm, gripping of the inner handle and moving the exercise bar laterally to the fullest extension urges the outer handle 38 against the user's wrist, forcing the wrist to a more neutral position and relaxing the muscle tone. The outer handle 38 and extension 36 also provide a brace for hemiplegic and stroke patients. The relative position of the inner handle 34 to outer handle 38 also tends to inhibit inward rotation of patient's hands due to excessive tone in the user's biceps, pectoralis and forearm pronator muscles. The therapist can aid or assist the patient in completing the respective exercises by holding onto the second set of handles not being used by the patient.

The extension for the handles provides support to the weakened hand. Its top surface is preferably flat and smooth while the outer edges are rounded to eliminate sharp edges or corners. The bottom surface of the handle extension is smooth and flat so that the entire bar can stand independently of any external support. When accomplishing range of motion on a table top, the flat bottom surface gives stability to the motions and assists with keeping the forearm and wrist in a neutral position, rather than a pronated and flexed position. The most beneficial table top stretch requires the user to push the affected arm away from the body while the hand rests in the handles and the arms rests on the table top. With this motion, stretch is provided which counteracts the normal flexor synergy pattern. This stretch encourages wrist extension, supination, elbow extension, upper arm abduction, and shoulder external rotation. When bringing the arm back toward the trunk, the outer handles applies pressure to the back of the wrist of the patient and encourages wrist movement into extension. As the affected extremity moves toward midline, the wrist is further stretched into wrist extension, while the forearm is held in supination.

The instant invention may also be used for a range of motion while standing. The patient must have enough strength to hold onto the handles for this form of exercise. The non-affected arm can assist the afflicted arm with reaching up and away from the trunk. The affected hand and arm are kept in a position that encourages external rotation of the shoulder as it is raised, thereby reducing the possibility of impingement with assisted range of motion. The use of the instant invention encourages proprioceptive neuromuscular facilitation (PNF) patterns when being used for active assisted range of motion. The invention also encourages abduction, external rotation, elbow extension, supination, and wrist extension. The arrangement of the handles encourages proper upper extremity positioning during all of these exercises.

The instant invention may be used for orthopedic injuries as well. The arrangement of the handles encourages the appropriate position for shoulder rehabilitation exercises following orthopedic injuries or surgery. The angle of the handles and their spacing makes handling easy for a variety of exercises. The outer handles are arranged in a way that keeps the crossbar away from the body during exercises. The inner handles are closer together and make it easy to accomplish exercises that require the arms to be closer to the trunk, such as wrist exercises and shoulder external and internal rotation. Resistance is easily added to the exercises by the unaffected hand, creating an isotonic contraction throughout the entire range of the exercise.

In a preferred embodiment, the exercise bar is made from polyvinyl chloride tubing or pipe. This material is preferred because it is relatively inexpensive, abundant, easy to cut and assemble, and somewhat flexible, and lightweight. This type of material is particularly suited for light to moderate strength isotonic exercises. In addition, the adjustable crossbar assembly 12 can be extended to its maximum length (preferably no greater than one-half the user's height) to create a long leverage arm for rotational exercises. Yet, because the exercise bar is relatively light weight compared to other materials, the user is not as quickly fatigued by holding the bar away from the body. The joints interconnecting the handles in the handle assemblies and/or coupling the handle assemblies to the crossbar assembly may be configured to break down for easy storage.

The above description is of two possible embodiments of this invention. Modifications of the invention will occur to those skilled in the art and to those who make or use the invention. Therefore, it is understood that the embodiments shown in the drawings and described above are merely for illustrative purposes and not intended to limit the scope of the invention, which is interpreted according to the principles of patent law, including the doctrine of equivalents.

I claim:

1. An exercise bar, comprising in combination:

a crossbar assembly having two opposing ends;

a handle assembly attached to each of said opposing ends, said handle assembly further including:

a first handle having a first end attached to one of said opposing ends of said crossbar assembly, said first handle extending substantially perpendicular from said crossbar assembly;

an extension member coupled to a second end of said first handle and oriented at an acute angle with respect to an axis concentric with respect to said crossbar assembly;

a second handle having a first end connected to said extension member and extending generally parallel with said first handle; and a grip journaled on each of said first and second handles.

2. The exercise bar as defined in claim 1, wherein said crossbar assembly, includes:

a first tubular member;

a second tubular member received coaxially along said first tubular member; and a pin assembly for fixing a relative coaxial position of said first tubular member with respect to said second tubular member.

3. The exercise bar as defined in claim 1, wherein said grip includes:

a cylindrical inner member coaxially received along each of said first and second handles; and a polymeric covering on an outer surface of said cylindrical member.

4. The exercise bar assembly as defined in claim 1, wherein said extension member, includes:

a first portion for receiving one end of said first and second handles therein; and a second portion connected to said first portion for providing structural rigidity to said first portion.

5. The exercise bar as defined in claim 1, wherein said acute angle includes an angle between 1 degree and 89 degrees measured from a vertical plane including said crossbar assembly.

6. The exercise bar as defined in claim 1, wherein said acute angle includes an angle of about 45 degrees.

7. The exercise bar as defined in claim 1, wherein said crossbar assembly includes a bar of fixed length.

8. An exercise bar assembly, comprising in combination:

a coaxially adjustable crossbar assembly having opposing ends;

a pair of handles coupled to each of said first and second opposing ends, said handles extending generally perpendicularly therefrom and parallel with each other, each pair of handles including a first and a second handle interconnected to each other by an extension member, said first handle having a first end connected to one of said ends of said coaxially adjustable crossbar assembly, said extension member coupled to a second end of said first handle; and a grip journaled on each of said first and second handles such that said grip rotates with respect to said first and second handles.

9. The exercise bar assembly as defined in claim 8, wherein said extension member, includes:

a first portion having recesses for receiving one end of each of said first and second handles therein; and a second portion connected to said first portion for providing structural rigidity to said first portion.

10. The exercise bar assembly as defined in claim 8, wherein said coaxially adjustable crossbar, includes:

a first tubular member;

a second tubular member coaxially disposed within said first tubular member; and an indexing mechanism attached to said first tubular member and configured to engage said second tubular member thereby fixing a relative length of the coaxially adjustable crossbar.

11. The exercise bar as defined in claim 8, wherein said grip, includes:

an inner cylindrical member received over each of said first and second handles; and a polymeric material coaxially disposed about an exterior of said inner cylindrical member.

12. An exercise bar assembly, comprising in combination:

a least two coaxially disposed tubular members wherein a first of said at least two coaxially disposed tubular members is configured to telescopically slide with respect to a second of said at least two coaxially disposed tubular members, said at least two coaxially disposed tubular members defining two opposing ends;

a handle assembly disposed on a respective one of said two opposing ends, said handle assembly including a first handle having one end coupled to a respective one of said two opposing ends, a handle extension connected to said first handle, and a second handle connected to said handle extension wherein said second handle is generally parallel to said first handle and said second handle is offset from said first handle at an angle with respect to a longitudinal axis defined by said coaxially disposed tubular members;

a grip journaled on each of said first and second handles; and wherein said handle extension includes:

a first portion having recesses for receiving one end of each of said first and second handles therein, and a second portion connected to one side of said first portion for providing structural rigidity to said first portion.

13. The exercise bar assembly as defined in claim 12, further including an indexing member connected to said at least two coaxially disposed tubular members for fixing a relative position of said first of said at least two coaxially disposed tubular members with respect to said second of said at least two coaxially disposed tubular members.

14. The exercise bar as defined in claim 12, wherein said handle extension provides a base for standing the exercise bar upright, and supports a user's hands thereon.

* * * * *